US008217314B2

(12) United States Patent
Kim et al.

(10) Patent No.: US 8,217,314 B2
(45) Date of Patent: Jul. 10, 2012

(54) COOKING APPARATUS WITH DIVIDER

(75) Inventors: Tae Woo Kim, Busan (KR); Seok Weon Hong, Yongin-si (KR); Jong Chull Shon, Suwon-si (KR); Hyang Ki Kim, Suwon-si (KR); Ki Suk Jeon, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1135 days.

(21) Appl. No.: 12/078,574

(22) Filed: Apr. 1, 2008

(65) Prior Publication Data

US 2008/0308545 A1 Dec. 18, 2008

(30) Foreign Application Priority Data

Jun. 13, 2007 (KR) ..... 10-2007-0058047

(51) Int. Cl.
*A21B 1/00* (2006.01)

(52) U.S. Cl. ..... 219/400; 219/394

(58) Field of Classification Search ..... 219/400, 219/402, 389, 394, 681, 408, 506, 411, 412, 219/413, 492, 414, 388, 391, 393, 724; 99/474, 99/475, 476, 447, 352, 337, 339, 483; 126/21 A, 126/21 R, 339, 197, 273 R
See application file for complete search history.

(56) References Cited

U.S. PATENT DOCUMENTS 4,839,486 A * 6/1989 Tanigawa ..... 219/681
7,468,495 B2 * 12/2008 Carbone et al. ..... 219/400
2006/0289435 A1 * 12/2006 Park ..... 219/394
2007/0194015 A1 * 8/2007 Kim ..... 219/757

FOREIGN PATENT DOCUMENTS

| | | |
|---|---|---|
| DE | 10 2004 046 437 | 4/2006 |
| EP | 0 641 976 | 3/1995 |
| JP | 58-193031 | 11/1983 |
| KR | 10-2006-0044217 | 5/2006 |

OTHER PUBLICATIONS

Extended European Search Report for corresponding European Application 08155763.9-2301; dated May 19, 2009.

* cited by examiner

*Primary Examiner* — Tu B Hoang
*Assistant Examiner* — Phuong Nguyen
(74) *Attorney, Agent, or Firm* — Staas & Halsey LLP

(57) ABSTRACT

Disclosed herein is a cooking apparatus that is capable of partially heating a cooking chamber depending upon an amount of food to be cooked through a relatively simple mechanical structure without using an additional control unit. The cooking apparatus includes a cooking chamber, a hot air supply unit to supply hot air into the cooking chamber, and a divider to divide the cooking chamber. The hot air supply unit includes a heater, a blowing fan to supply air heated by the heater into the cooking chamber, a fan cover having inlet holes and outlet holes, an opening and closing cover to partially open and close the inlet holes and the outlet holes of the fan cover, and interlocking units operating together with the attachment and detachment of the divider to move the opening and closing cover.

16 Claims, 15 Drawing Sheets

COOKING APPARATUS WITH DIVIDER

CROSS-REFERENCE TO RELATED APPLICATIONS

This application claims the benefit of Korean Patent Application No. 2007-58047, filed on Jun. 13, 2007 in the Korean Intellectual Property Office, the disclosure of which is incorporated herein by reference.

BACKGROUND

1. Field

The present invention relates to a cooking apparatus, and, more particularly, to a cooking apparatus that cooks food using a blowing fan.

2. Description of the Related Art

Generally, a conventional convection-type cooking apparatus includes a heater energized to emit heat, an oven cavity in which food is cooked by heat emitted from the heater, a blowing fan mounted in the oven cavity to circulate air in the oven cavity by convection, convection inlet holes mounted at a rear of the cavity to suction the air circulated by the rotation of the blowing fan, convection outlet holes mounted at the rear of the cavity to discharge the air circulated by the rotation of the blowing fan, and a plurality of trays mounted in the oven cavity to allow food to be placed thereon.

When a user puts food in the oven cavity and inputs a cooking command, the blowing fan is driven to suction air from the oven cavity, the suctioned air is heated by the heater, and the heated air is discharged into the oven cavity. In this way, air is forcibly circulated in the conventional cooking apparatus. During the circulation of the air, the food is in continuous contact with high-temperature air, with the result that heat is transmitted to the food, and therefore, the food is cooked by the heat.

However, the conventional cooking apparatus has a single oven cavity. As a result, even when it is necessary to cook a small amount of food, the entire oven cavity is heated. Consequently, a cooking time and power consumption are increased.

In order to solve the problem, Korean Patent Application Publication No. 10-2006-44217 discloses an electric oven constructed in a structure in which a cooking chamber is divided into upper and lower cooking chambers by a partition, such that the upper and lower cooking chambers are selectively used, thereby reducing the cooking time and power consumption.

Specifically, the disclosed electric oven includes an oven body having a cooking chamber defined therein, a door to open and close the cooking chamber, a heater unit mounted in the oven body to heat the cooking chamber, a partition detachably mounted in the cooking chamber to divide the cooking chamber into a first cooking chamber and a second cooking chamber, a mode selection unit to select a single cooking mode in which food is cooked in the cooking chamber while the partition is separated from the cooking chamber and a double cooking mode in which food is cooked in the cooking chamber while the partition is mounted in the cooking chamber, and a control unit to control the mode selection unit to select the single cooking mode or the double cooking mode based on a determination as to whether the partition is mounted in or separated from the cooking chamber.

However, the oven is constructed in a structure in which the cooking chambers are selectively heated. Consequently, it is necessary to mount a heater and a blowing fan in each of the first and second cooking chambers that are divided by the partition when the partition is mounted within the oven body. Also, it is required that various components, such as a sensor to sense whether the partition is mounted in or separated from the cooking chamber, be electrically connected and controlled. Furthermore, it is required that the mode selection unit be divided into mode selection units corresponding to the single cooking mode and the double cooking mode. As a result, the structure and control of the oven are complicated, and the manufacturing costs of the oven are increased.

According to the conventional art disclosed in the Publication, when it is necessary to selectively supply heated air into one of the first and second cooking chambers, an on/off operation of the blowing fan or an on/off operation of the heater must be performed in order to interrupt a supply of the heated air into the other cooking chamber. The frequent on/off operation of the heater and the blowing fan shortens the life span of the components constituting the oven.

SUMMARY

Therefore, it is an aspect of the embodiments to provide a cooking apparatus that is capable of partially heating a cooking chamber depending upon an amount of food to be cooked through a relatively simple mechanical structure without using an additional control unit.

It is another aspect of the embodiments to provide a cooking apparatus that is capable of opening and closing inlet holes and outlet holes formed at a fan cover, when the cooking chamber is partially heated, such that the supply of hot air to a predetermined space is allowed or interrupted, thereby preventing a frequent on/off operation of a blowing fan or a heater and thus increasing the life span of components of the cooking apparatus.

Additional aspects and/or advantages will be set forth in part in the description which follows and, in part, will be apparent from the description, or may be learned by practice of the invention.

The foregoing and/or other aspects are achieved by providing a cooking apparatus including a cooking chamber, a hot air supply unit to supply hot air into the cooking chamber, the hot air supply unit including a heater, a blowing fan to supply air heated by the heater into the cooking chamber, a fan cover having inlet holes and outlet holes, an opening and closing cover to partially open and close the inlet holes and the outlet holes of the fan cover, and interlocking units, and a divider to divide the cooking chamber, wherein the interlocking units operate together with the divider in attachment and detachment of the divider to move the opening and closing cover.

The opening and closing cover may be provided at a rear thereof with hooks, and the fan cover may be provided at a front thereof with hook grooves to receive the hooks. The opening and closing cover may be coupled to a front of the fan cover by insertion of the hooks into the hook grooves.

Each interlocking unit may include a rotary shaft fixed to the opening and closing cover and an interlocking part coupled to the rotary shaft such that the interlocking part is rotated upon the attachment and detachment of the divider. The interlocking part may include a first rotation part brought into contact with the divider and rotated upon the attachment of the divider and a second rotation part spaced a predetermined angle from the first rotation part, the second rotation part operating together with the rotation of the first rotation part to press a top surface of the divider. The first rotation part may have a weight greater than that of the second rotation part such that the first rotation part is located below the second rotation part due to the weight of the first rotation part before the attachment of the divider. The first and second rotation parts may have rounded side ends.

In a modification, each interlocking unit may include a first rack formed at the divider, a pinion protruding from an inside of the cooking chamber such that the pinion is rotated by a forward-and-backward movement of the first rack, and a second rack mounted to the opening and closing cover to move with the rotation of the pinion. The pinion may include a first pinion part coupled to the first rack and a second pinion part coupled to the second rack.

In another modification, each interlocking unit may include a rotary shaft fixed to the opening and closing cover and a roller rotatably coupled to the rotary shaft. In this case, the divider may have inclined or rounded ends such that the divider pushes the roller upward, while being in smooth contact with the roller, with the insertion of the divider.

The fan cover and the opening and closing cover may protrude from a rear of the cooking chamber, the divider may have an insertion groove to surround the fan cover and the opening and closing cover, and each interlocking unit may be mounted to an edge of the opening and closing cover.

In a modification, the fan cover may protrude from a rear or a side of the cooking chamber, the fan cover may have a guide groove to receive the divider, the opening and closing cover may have a bent portion corresponding to the guide groove of the fan cover, and each interlocking unit may be mounted to the bent portion of the opening and closing cover.

The foregoing and/or other aspects are achieved by providing a cooking apparatus including a cooking chamber, a hot air supply unit to supply hot air into the cooking chamber, and a divider to divide the cooking chamber into a plurality of chambers, wherein the hot air supply unit operates together with an insertion of the divider into the cooking chamber to interrupt the supply of hot air to any one of the divided chambers.

The hot air supply unit may include a blowing fan to supply air into the cooking chamber, a fan cover having inlet holes and outlet holes, an opening and closing cover to partially open and close the inlet holes and the outlet holes of the fan cover, and interlocking units to move the opening and closing cover upward or downward in attachment and detachment of the divider into the cooking chamber.

Each interlocking unit may be constructed in various structures as previously described. For example, each interlocking unit may include a rotary shaft fixed to the opening and closing cover and an interlocking part coupled to the rotary shaft such that the interlocking part is rotated upon the attachment and detachment of the divider.

As an alternative, each interlocking unit may include a first rack formed at the divider, a pinion protruding from an inside of the cooking chamber such that the pinion is rotated by a forward-and-backward movement of the first rack, and a second rack mounted to the opening and closing cover to move with the rotation of the pinion.

As another alternative, each interlocking unit may include a rotary shaft fixed to the opening and closing cover and a roller rotatably coupled to the rotary shaft.

As previously described, the fan cover and the opening and closing cover may protrude from the rear of the cooking chamber, the divider may have an insertion groove to surround the fan cover and the opening and closing cover, and each interlocking unit may be mounted to an edge of the opening and closing cover.

In a modification, the fan cover may protrude from a rear or a side of the cooking chamber, the fan cover may have a guide groove to receive the divider, the opening and closing cover may have a bent portion corresponding to the guide groove of the fan cover, and each interlocking unit may be mounted to the bent portion of the opening and closing cover.

The foregoing and/or other aspects are achieved by providing a cooking apparatus, including: a cooking chamber; at least one hot air supply unit to supply hot air to the cooking chamber, the hot air supply unit including a fan, a fan cover having at least two sets of inlet holes and outlet holes, an opening and closing cover having inlet holes and outlet holes, and interlocking units, the at least one hot air supply unit being attached to a wall of the cooking chamber; and a divider receivable into the cooking chamber to divide the cooking chamber into a plurality of chambers, wherein when the divider is inserted into the cooking chamber, the interlocking units are rotated, causing the opening and closing cover to rotate with respect to the fan cover.

When the divider is not inserted into the cooking chamber, the inlet and outlet holes of the opening and closing cover may be arranged in parallel to a first set of the inlet and outlet holes of the fan cover, thereby permitting air to flow in the inlet holes of the opening and closing cover and the fan cover and out the outlet holes of the opening and closing cover and the fan cover, and when the divider is inserted into the cooking chamber and the interlocking units are rotated, the inlet and outlet holes of the opening and closing cover may not be arranged in parallel to the first set of inlet and outlet holes of the fan cover so that the first set of inlet and outlet holes of the fan cover are covered, thereby prohibiting the air from flowing in the inlet holes of the opening and closing cover and the first set of inlet holes of the fan cover, and out the outlet holes of the opening and closing cover and the first set of outlet holes of the fan cover.

The foregoing and/or other aspects are achieved by providing a hot air supply unit for a cooking apparatus, the hot air supply unit being attached to a wall of a cooking chamber of the cooking apparatus to supply hot air to the cooking chamber, including: a fan; a fan cover having at least two sets of inlet and outlet holes; an opening and closing cover having inlet holes and outlet holes; and interlocking units, wherein when a divider is inserted into the cooking chamber, the interlocking units are rotated, causing the opening and closing cover to rotate with respect to the fan cover and close at least a first set of inlet and outlet holes of the fan cover.

BRIEF DESCRIPTION OF THE DRAWINGS

These and/or other aspects and advantages will become apparent and more readily appreciated from the following description of the embodiments, taken in conjunction with the accompanying drawings, of which.

DETAILED DESCRIPTION OF THE EMBODIMENTS

Figure 1:
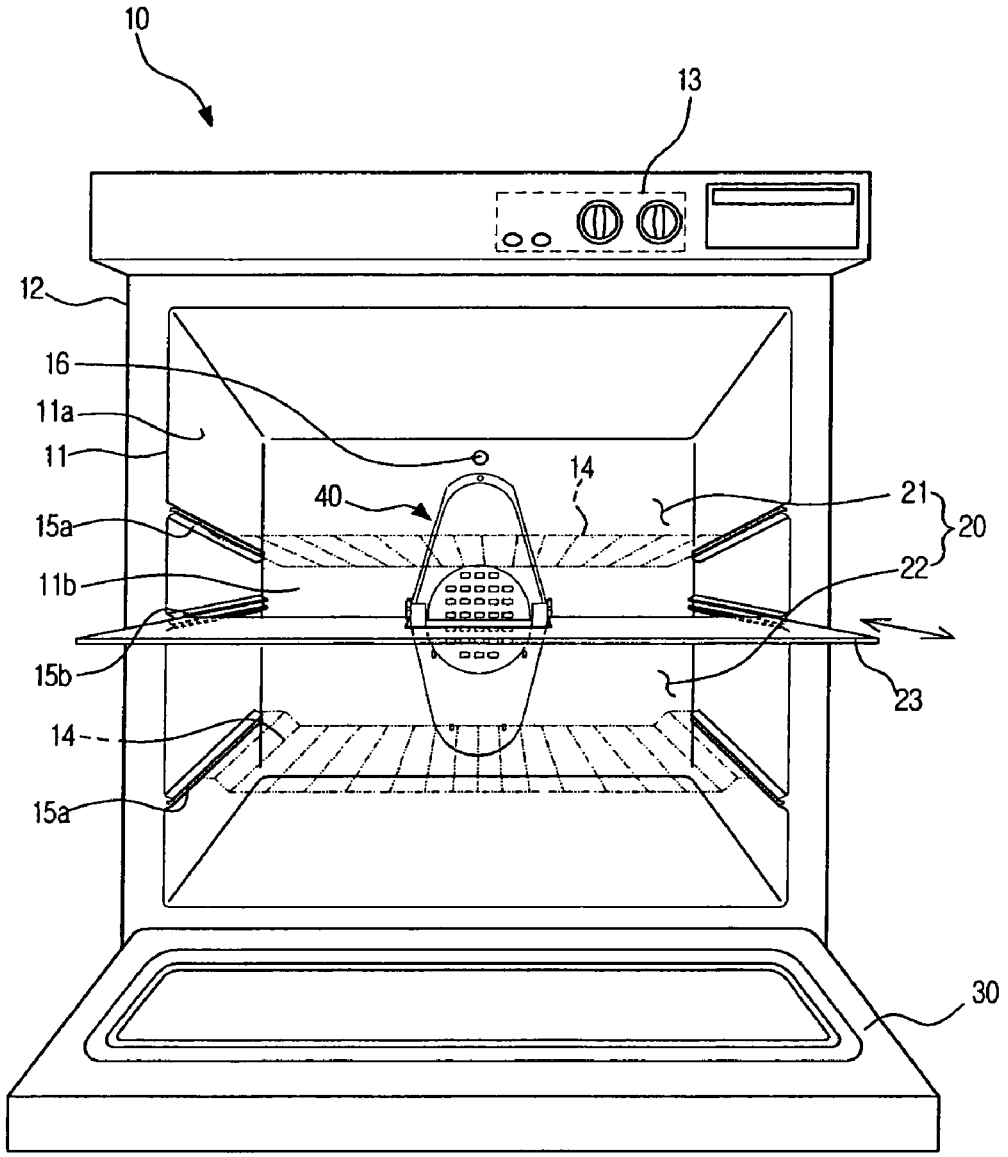
FIG. 1 is a perspective view schematically illustrating a structure of a cooking apparatus according to a first embodiment.

Reference will now be made in detail to the embodiments, examples of which are illustrated in the accompanying drawings, wherein like reference numerals refer to like elements throughout. The embodiments are described below to explain the present invention by referring to the figures.

First, a cooking apparatus according to a first embodiment will be described in detail.

FIG. 1 is a perspective view schematically illustrating a structure of a cooking apparatus according to a first embodiment of the present invention.

As shown in FIG. 1, the cooking apparatus includes a main body 10 open at a front thereof and having a cooking chamber 20 defined therein, a door 30 hingedly mounted to the front of the main body 10 to open and close the cooking chamber 20, a divider 23 detachably mounted in the cooking chamber 20 to divide the cooking chamber 20 into a plurality of cooking spaces, and a hot air supply unit 40 mounted at the main body 10 to supply hot air into the cooking chamber 20.

The main body 10 includes an inner case 11 including sidewalls 11*a* defining the cooking chamber 20, an outer case 12 defining an external appearance of the cooking apparatus, and a control panel 13 mounted at an upper part of the outer case 12, for example, to allow a user to input a cooking kind, a cooking time, and a cooking temperature. However, the control panel may be mounted anywhere on the main body 10.

The inner case 11 defines the cooking chamber 20, opened and closed by the door 30, which is hingedly mounted to the front of the main body 10. The inner case 11 is provided at each side thereof with a plurality of guides 15 (15*a*, 15*b*) to guide the attachment and detachment of trays 14 on which food is placed. Among the guides 15 (15*a*, 15*b*), the middle guides 15*b*, affixed to opposite sides of the cooking chamber 20, serve to guide an attachment and detachment of the divider 23, which divides the cooking chamber 20 into upper and lower cooking chambers. A corresponding tray 14 may also be included, which may divide the cooking chamber 20.

Consequently, when the divider 23 is mounted in the cooking chamber 20 along the middle guides 15*b*, the cooking chamber 20 is divided into a first cooking chamber 21, which is an upper part of the cooking chamber 20, and a second cooking chamber 22, which is a lower part of the cooking chamber 20.

The divider 23 is formed approximately in the shape of a rectangle, for example, but may be formed in any shape that would allow the divider 23 to be situated within the cooking chamber 20. The divider 23 has an insertion groove 23*a* (see FIG. 3), in which the hot air supply unit 40 is inserted such that the flow of air between the first and second cooking chambers 21 and 22 is minimized when the divider 23 is mounted in the cooking chamber 20. Also, the divider 23 contains an insulation material to prevent heat transfer between the first and second cooking chambers 21 and 22.

To an upper part of the rear 11*b* of the inner case 11 is mounted a cooking chamber temperature sensor 16 to measure the temperature of the cooking chamber 20. The hot air supply unit 40 is located below the temperature sensor 16 to supply hot air into the cooking chamber 20.

Hereinafter, the operational relationship between the divider 23 and the hot air supply unit 40 according to the first embodiment will be described in detail with reference to FIGS. 2 to 6.

Figure 2:
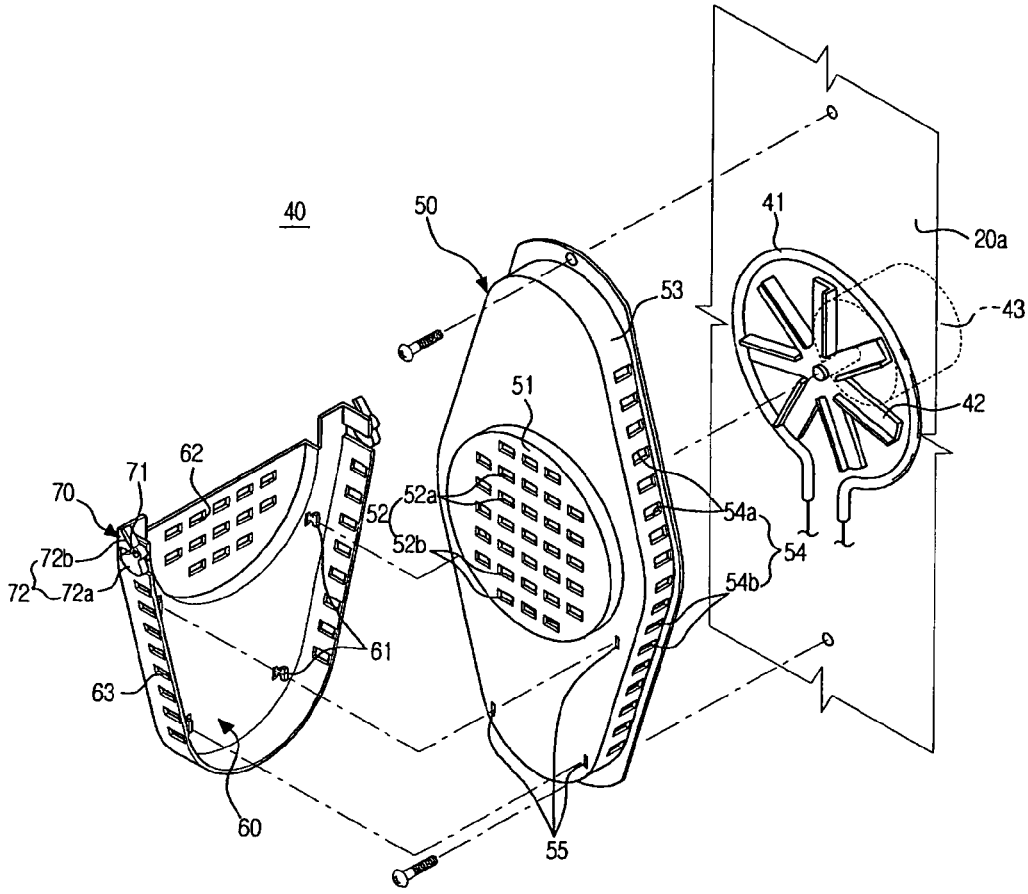
FIG. 2 is an exploded perspective view illustrating a hot air supply unit of the cooking apparatus according to the first embodiment.
Figure 3:
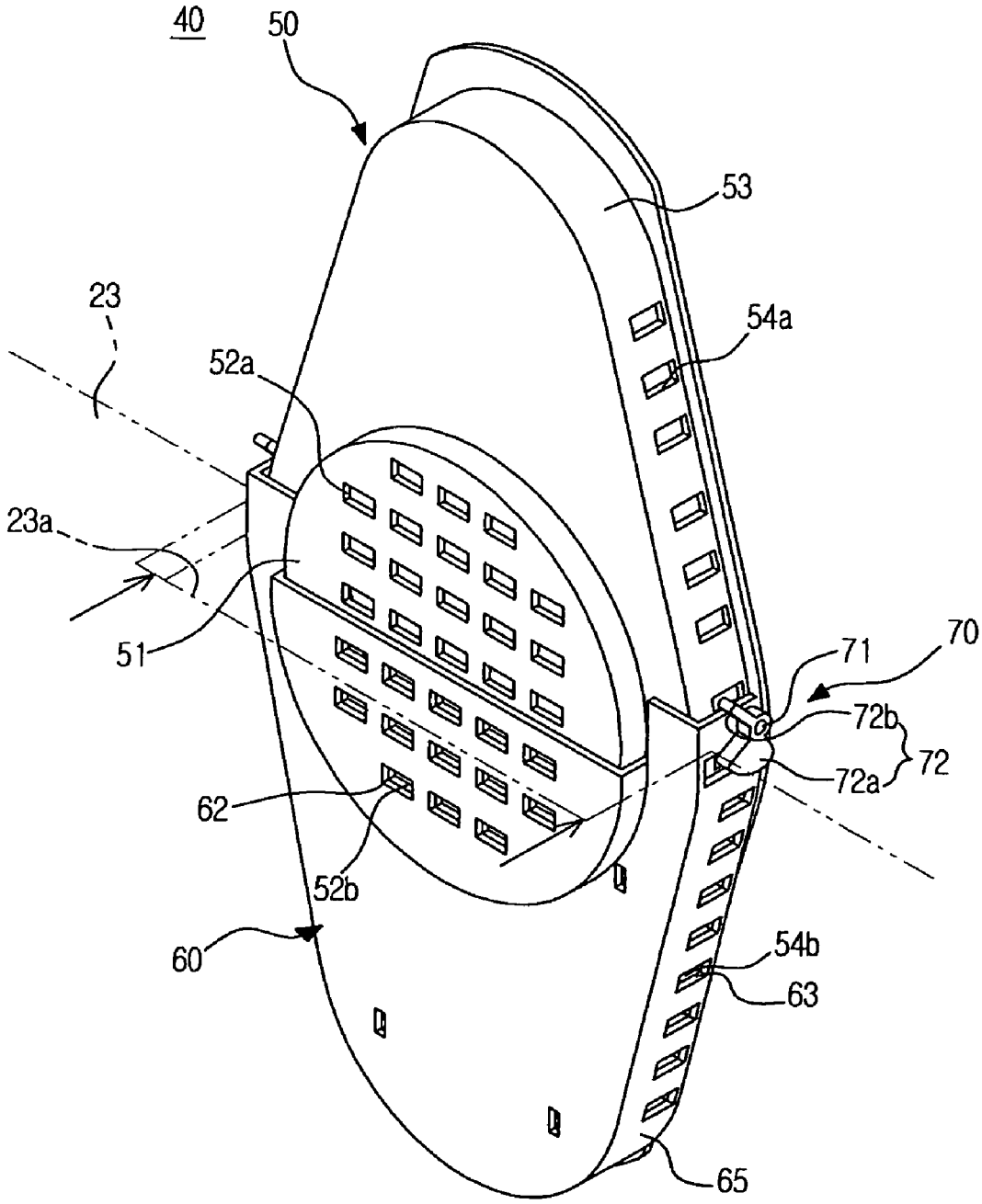
FIG. 3 is a perspective view illustrating principal components of the cooking apparatus according to the first embodiment while a divider is separated from a cooking chamber of the cooking apparatus.
Figure 4:
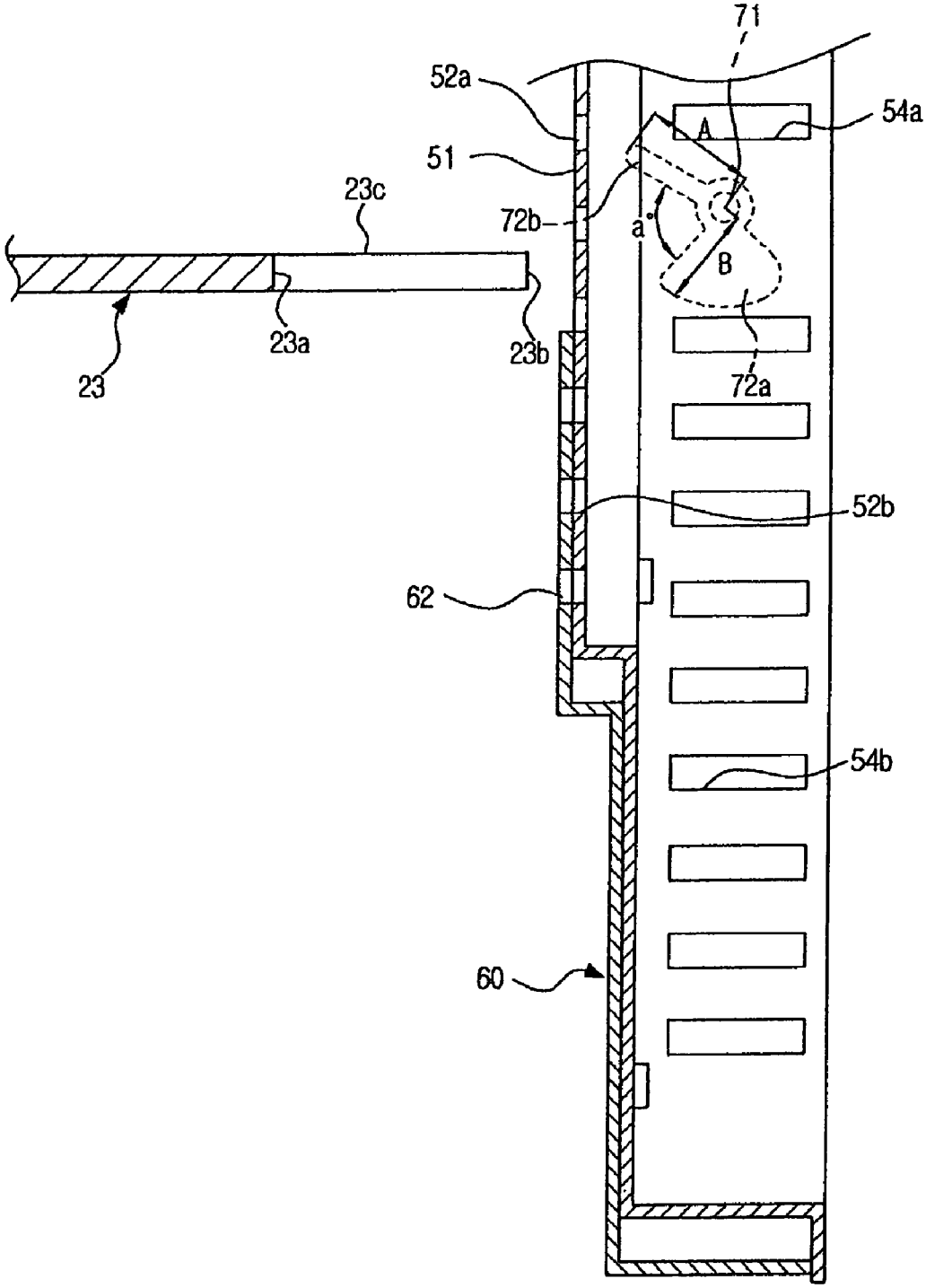
FIG. 4 is a side view of the divider and the hot air supply unit before the divider of FIG. 3 is mounted in the cooking chamber.
Figure 5:
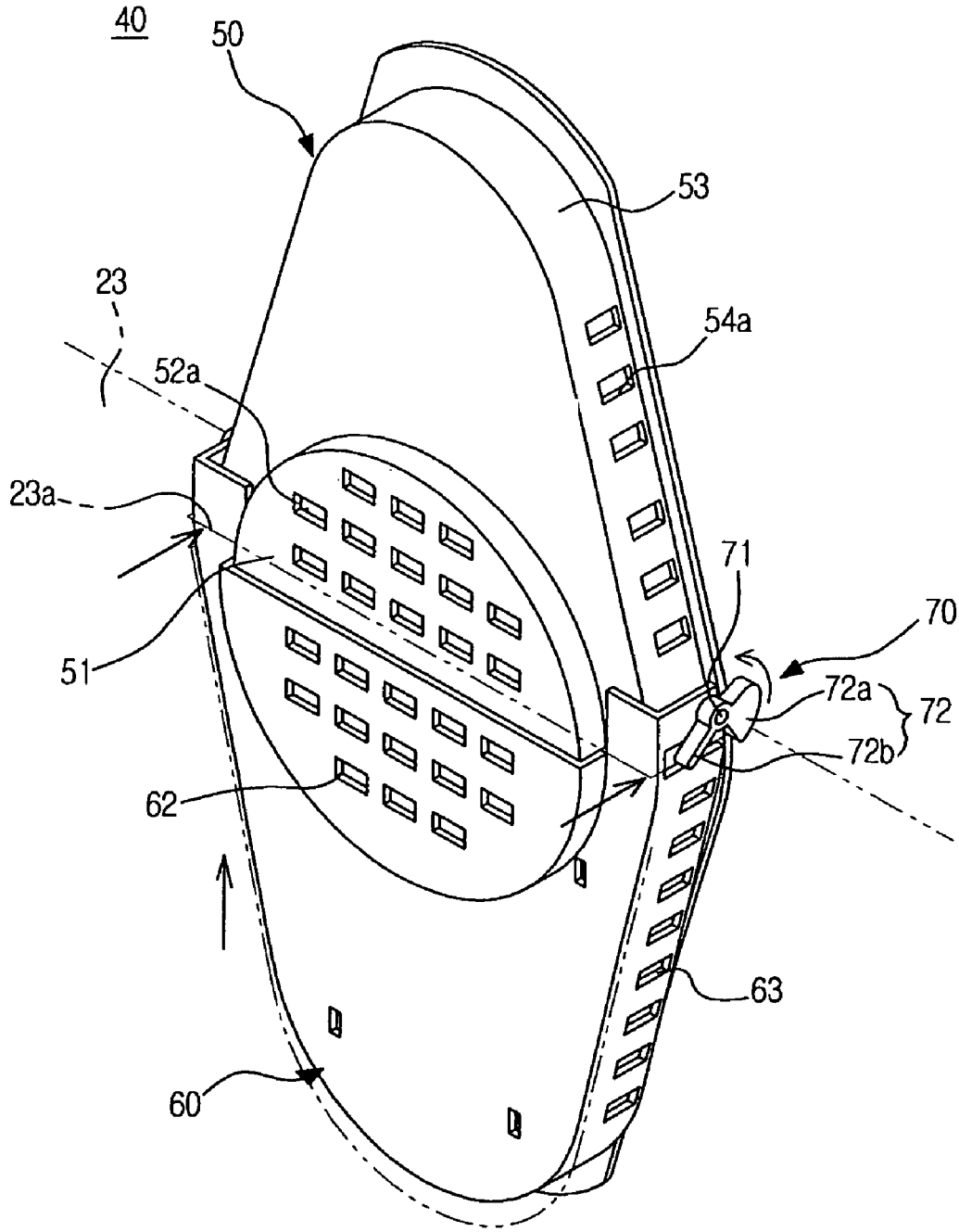
FIG. 5 is a perspective view illustrating principal components of the cooking apparatus according to the first embodiment while the divider is mounted in the cooking chamber.
Figure 6:
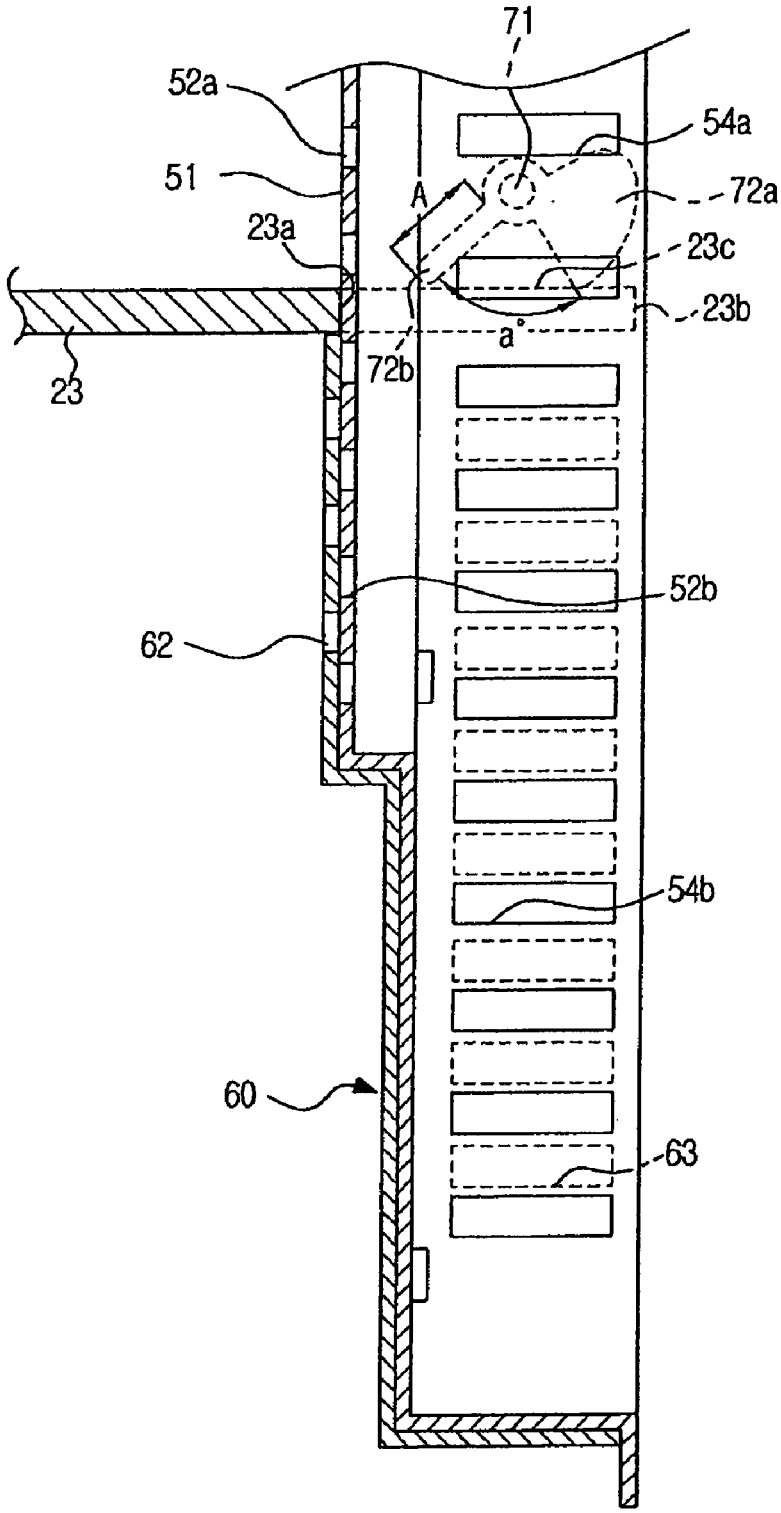
FIG. 6 is a side view of the divider and the hot air supply unit after the divider of FIG. 5 is mounted in the cooking chamber.

FIG. 2 is an exploded perspective view of the hot air supply unit included in the cooking apparatus according to the first embodiment, FIG. 3 is a perspective view illustrating principal components of the cooking apparatus according to the first embodiment while the divider is separated from the cooking chamber of the cooking apparatus, FIG. 4 is a side view of the divider and the hot air supply unit before the divider of FIG. 3 is mounted in the cooking chamber, FIG. 5 is a perspective view illustrating principal components of the cooking apparatus according to the first embodiment while the divider is mounted in the cooking chamber, and FIG. 6 is a side view of the divider and the hot air supply unit after the divider of FIG. 5 is mounted in the cooking chamber.

As shown in FIG. 2, the hot air supply unit 40 includes a heater 41, a blowing fan 42 mounted in the heater 41 to forcibly supply air heated by the heater 41 into the cooking chamber 20, a fan cover 50 having inlet holes 52 (52*a*, 52*b*) and outlet holes 54 (54*a*, 54*b*) to cover the blowing fan 42, an opening and closing cover 60 to open and close the inlet holes 52*b* and the outlet holes 54*b* which are formed at the lower part of the fan cover 50, and interlocking units 70 mounted at opposite sides of the opening and closing cover 60 to operate together with the attachment and detachment of the divider 23 to move the opening and closing cover 60 upward and downward.

The heater 41 is mounted at a center of the rear 11*b* of the inner case 11 to heat air introduced into the fan cover by the blowing fan 42. In this embodiment, the heater 41 is formed in a ring shape, although the heater 41 may be formed in any of a variety of shapes.

The blowing fan 42 forcibly circulates air in the cooking chamber 20 to accelerate heat transfer. Specifically, the blowing fan 42 supplies hot air to food received in the cooking chamber 20 to accelerate heat transfer. In this embodiment, the blowing fan 42 is a centrifugal fan, for example, although the blowing fan 42 may be an axial flow fan. The blowing fan 42 is operated simultaneously with the driving of the heater 41. According to circumstances, however, the blowing fan 42 may be operated independently even when the heater 41 is not driven. To the rear of the blowing fan 42 is mounted a fan motor 43 to drive the blowing fan 42.

The fan cover 50 is located in front of the blowing fan 42 and the heater 41 to cover the blowing fan 42 and the heater 41.

The fan cover 50 is formed approximately in the shape of an oval having a vertical length greater than a lateral length. The fan cover 50 protrudes forward from the rear 11*b* of the inner case 11. Air forcibly blown by the blowing fan 42 is suctioned and discharged through the inlet holes 52 and the outlet holes 54 of the fan cover 50, respectively. The fan cover 50 may be formed in any of a variety of shapes, such as a circle or a polygon, having a size sufficient to cover the blowing fan 42 and the heater 41.

The inlet holes 52 are formed at a central front 51 of the fan cover 50 corresponding to a front of the blowing fan 42 to suction air from the cooking chamber 20. The inlet holes 52 include upper inlet holes 52*a* formed at the upper part of the fan cover 52, and lower inlet holes 52*b* formed at a lower part of the fan cover 52.

The outlet holes 54 are formed at a side edge 53 of the fan cover 50 corresponding to a side of the blowing fan 42 to discharge air heated by the heater 41 into the cooking chamber 20. The outlet holes 54 include upper outlet holes 54*a* formed at an upper part of the fan cover 52, and lower outlet holes 54*b* formed at a lower part of the fan cover 52.

In the cooking apparatus according to the first embodiment, the opening and closing cover 60 is mounted to a lower front of the fan cover 50 to open and close the lower inlet holes 52*b* and the lower outlet holes 54*b* of the fan cover 50.

A plurality of grooves 55 is formed at the front of the fan cover 50 such that the opening and closing cover 60 is vertically coupled to the fan cover 50 in a slidable fashion. The opening and closing cover 60 is provided at a rear thereof with a plurality of hooks 61 corresponding to the grooves 55 of the fan cover 50. The hooks 61 of the opening and closing cover 60 are insertable in the corresponding grooves 55 of the fan cover 50.

Also, the opening and closing cover 60 has inlet holes 62 and outlet holes 63. The inlet holes 62 and outlet holes 63 of the opening and closing cover 60 correspond to the lower inlet holes 52*b* and the lower outlet holes 54*b* of the fan cover 50, respectively. When the divider 23 is not mounted in the cooking chamber 20, as shown in FIG. 3, the inlet holes 62 and outlet holes 63 of the opening and closing cover 60 communicate with the lower inlet holes 52*b* and the lower outlet holes 54*b* of the fan cover 50, respectively. As a result, air is suctioned from the cooking chamber 20 into the hot air supply unit 40 through the upper and lower inlet holes 52*a* and 52*b*, and the air heated by the heater 41 is uniformly supplied into the cooking chamber 20 through the upper and lower outlet holes 54*a* and 54*b*.

On the other hand, when the divider 23 is mounted in the cooking chamber 20, with the result that the cooking chamber 20 is divided into the first and second cooking chambers 21 and 22, as shown in FIG. 5, the opening and closing cover 60 moves upward to close the lower inlet holes 52*b* and the lower outlet holes 54*b* of the fan cover 50. As a result, air is suctioned from the first cooking chamber 21 into the hot air supply unit 40 only through the upper inlet holes 52*a* by the blowing fan 42. The suctioned air is heated by the heater 41 and is supplied into the first cooking chamber 21 only through the upper outlet holes 54*a*. At this time, the supply of hot air into the second cooking chamber 22 is interrupted.

Hereinafter, the interlocking units 70, which operate together with the attachment and detachment of the divider 23 to move the opening and closing cover 60 such that the opening and closing cover 60 opens and closes the lower inlet holes 52*b* and the lower outlet holes 54*b* of the fan cover 50, will be described.

The interlocking units 70 operate together with the attachment and detachment of the divider 23 to move the opening and closing cover 60 upward and downward such that the opening and closing cover 60 opens and closes the lower inlet holes 52*b* and the lower outlet holes 54*b* of the fan cover 50.

As shown in FIGS. 3 and 5, the interlocking units 70 are mounted at opposite sides of the opening and closing cover 60. Each interlocking unit 70 includes a rotary shaft 71 protruding from an edge 65 of the opening and closing cover 60 and an interlocking part 72 coupled to the rotary shaft 71 such that the interlocking part 72 is rotated upon the attachment and detachment of the divider 23.

The interlocking part 72 includes a first rotation part 72*a* brought into contact with a front end 23*b* of the divider 23 and rotated upon the attachment of the divider 23, and a second rotation part 72*b* spaced a predetermined angle from the first rotation part 72*a*. The second rotation part 72*b* operates together with the rotation of the first rotation part 72*a* to press a top of the divider 23.

The first rotation part 72*a* has a weight greater than that of the second rotation part 72*b* such that the first rotation part 72*a* is located below the second rotation part 72*b* due to its weight before the divider is mounted in the cooking chamber (i.e., when an external force is not applied to the first rotation part 72*a*). When the divider is inserted in the cooking chamber, the front end and the top of the divider are pressed by the first and second rotation parts 72*a* and 72*b*. Consequently, the side ends of the first and second rotation parts 72*a* and 72*b* are preferably rounded, but are not limited thereto.

When the divider 23 is mounted in the cooking chamber, as shown in FIGS. 4 and 6, the front end 23*b* of the divider 23 pushes the first rotation part 72*a* to rotate the interlocking part 72. As a result, the second rotation part 72*b* is brought into contact with a top 23*c* of the divider 23. When the divider 23 is further inserted into the cooking chamber, the hooks 61 of the opening and closing cover 60 are guided along the grooves 55 of the fan cover 50 by a force that the ends of the first and second rotation parts 72*a* and 72*b* apply to the divider 23, with the result that the opening and closing cover 60 is moved upward.

Consequently, the inlet holes 62 and the outlet holes 63 of the opening and closing cover 60 are not aligned with the lower inlet holes 52*b* and the lower outlet holes 54*b* of the fan cover 50, and therefore, the opening and closing cover 60 closes the lower inlet holes 52*b* and the lower outlet holes 54*b* of the fan cover 50, so that a supply of hot air from the hot air supply unit into the second cooking chamber 22 below the divider 23 is interrupted.

At this time, a rise height of the opening and closing cover 60 due to the attachment of the divider 23 is changed by a length B of the first rotation part 72*a*, a length A of the second rotation part 72*b*, and a spaced angle a° between the first and second rotation parts 72*a* and 72*b*. Also, the spaced intervals of the inlet holes 62*a* and the outlet holes 63 of the opening and closing cover 60 and the lower inlet holes 52*b* and the lower outlet holes 54*b* of the fan cover 50 must be considered.

Consequently, it is necessary to appropriately adjust the lengths B and A of the first and second rotation parts 72*a* and 72*b*, the spaced angle a° between the first and second rotation parts 72*a* and 72*b*, the vertically spaced intervals of the lower inlet holes 52*b* and the lower outlet holes 54*b* of the fan cover 50, and the vertically spaced intervals of the inlet holes 62*a* and the outlet holes 63 of the opening and closing cover 60, in designing the hot air supply unit. Thus, the opening and closing cover 60 is able to communicate with the fan cover 50 when the divider 23 is separated from the cooking chamber, and the opening and closing cover 60 is able to close the lower inlet holes 52*b* and the lower outlet holes 54*b* of the fan cover 50 due to the upward movement of the opening and closing cover 60 when the divider 23 is mounted in the cooking chamber.

Figure 7:
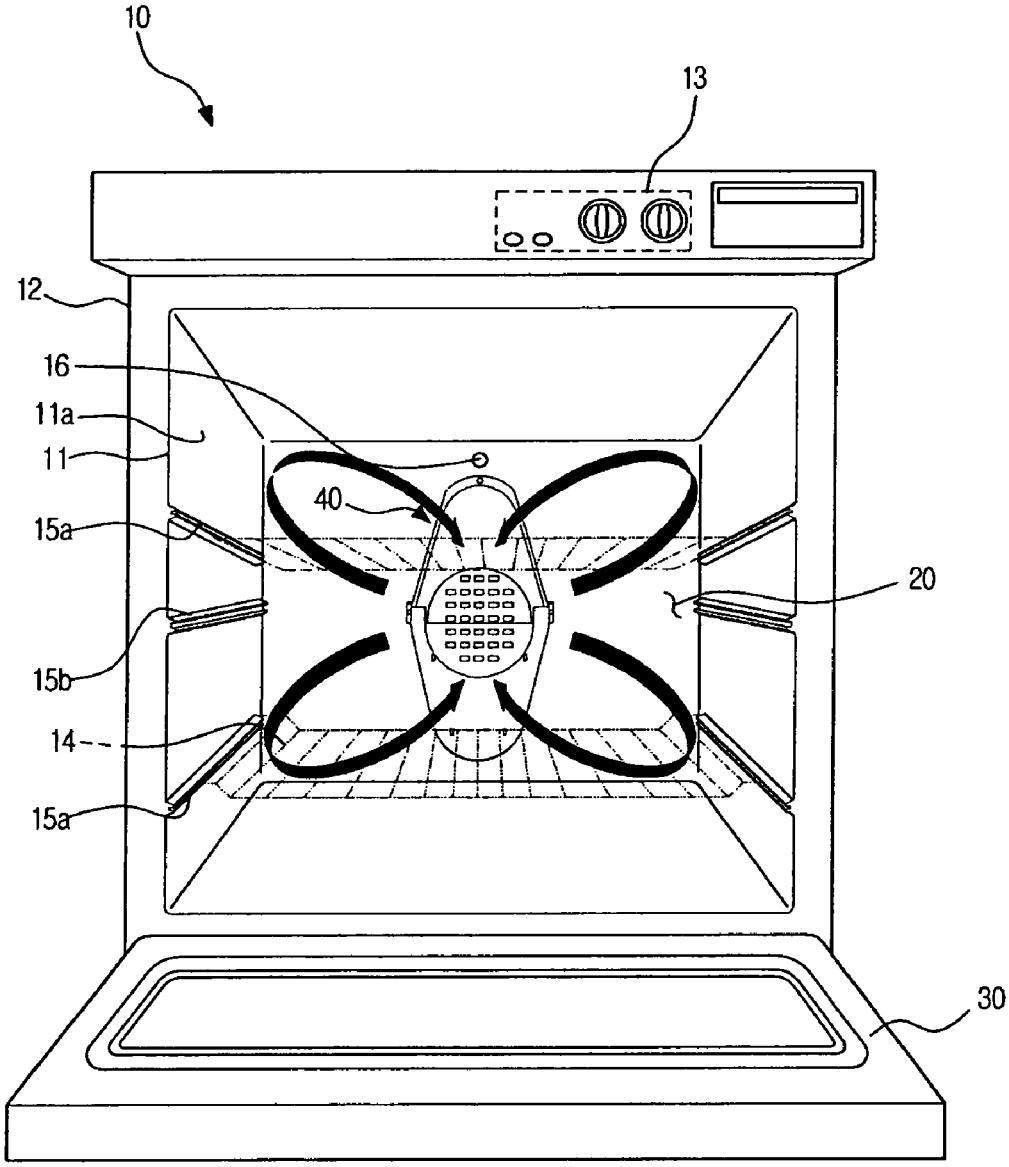
FIG. 7 is a perspective view illustrating the circulation of air in the cooking apparatus according to the first embodiment while the divider is separated from the cooking chamber.
Figure 8:
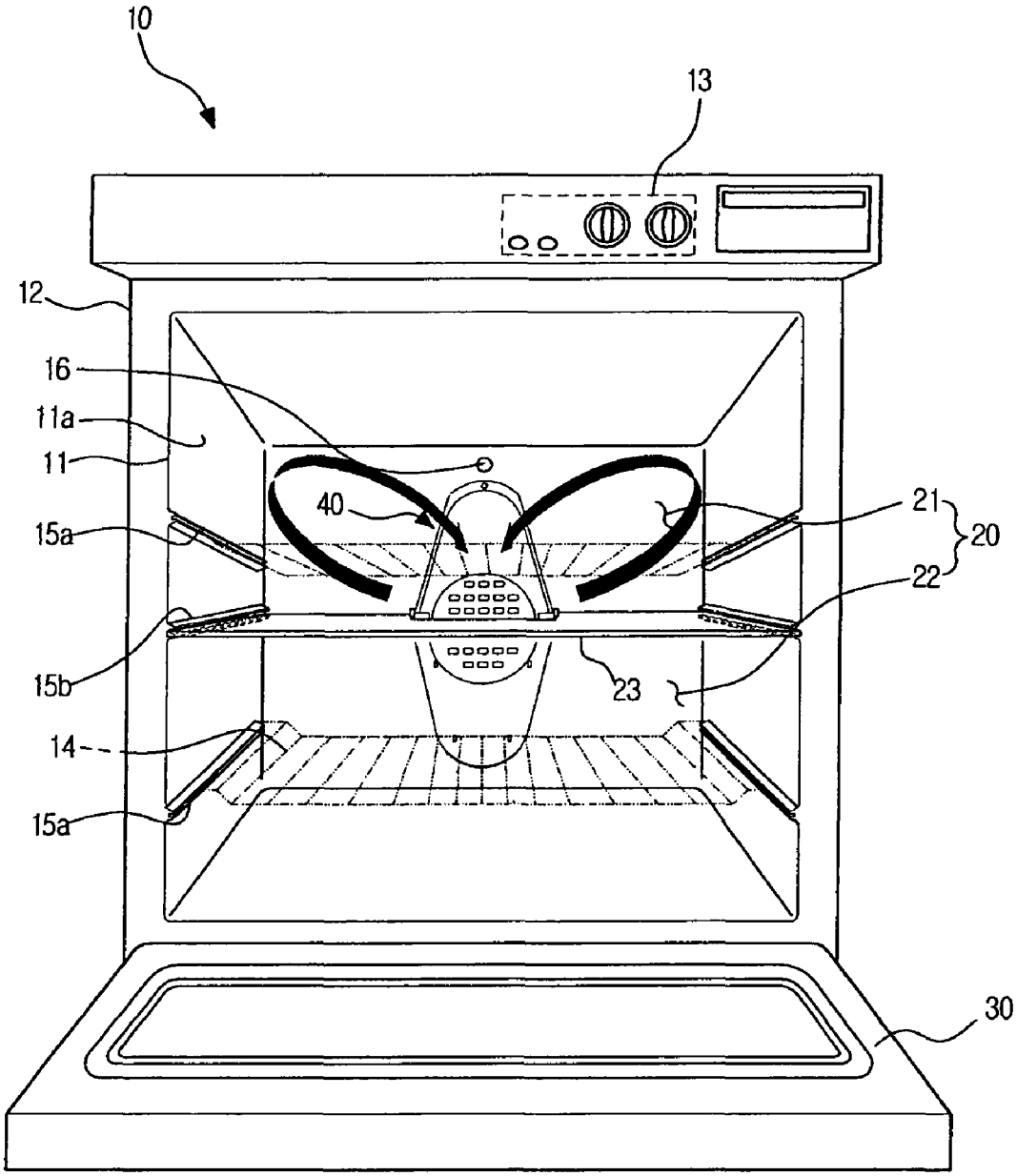
FIG. 8 is a perspective view illustrating the circulation of air in the cooking apparatus according to the first embodiment while the divider is mounted in the cooking chamber.

FIG. 7 is a perspective view illustrating the circulation of air in the cooking apparatus according to the first embodiment while the divider is separated from the cooking chamber, and FIG. 8 is a perspective view illustrating the circulation of air in the cooking apparatus according to the first embodiment of the present invention while the divider is mounted in the cooking chamber.

When the divider 23 is not mounted in the cooking chamber 20, as shown in FIG. 7, air is suctioned from the cooking chamber 20 into the hot air supply unit 40 through the inlet holes 52 located at the center of the fan cover 50 by the rotation of the blowing fan 42. The air is blown in the circumferential direction of the blowing fan 42. The air, blown in the circumferential direction of the blowing fan 42, is heated by the heater 41 and is resupplied into the cooking chamber 20 through the outlet holes 54. In this way, hot air is circulated uniformly in the cooking chamber, and food is cooked while being heated by the hot air.

On the other hand, when the divider 23 is mounted in the cooking chamber 20, as shown in FIG. 8, the cooking chamber is divided into the first cooking chamber 21, i.e., the upper cooking chamber, and the second cooking chamber 22, i.e., the lower cooking chamber, and the opening and closing cover 60 closes the lower inlet holes 52*b* and the lower outlet holes 54*b* of the fan cover 50 located in the second cooking chamber 22 by the interlocking units 70, which operate together with the attachment and detachment of the divider 23. As a result, hot air is supplied into only the first cooking chamber 21, for example.

Consequently, the present embodiment has the effect of controlling the supply of hot air into the second cooking chamber only by the attachment and detachment of the divider, accomplished through a relatively simple mechanical structure, without using an additional control unit.

Figure 9:
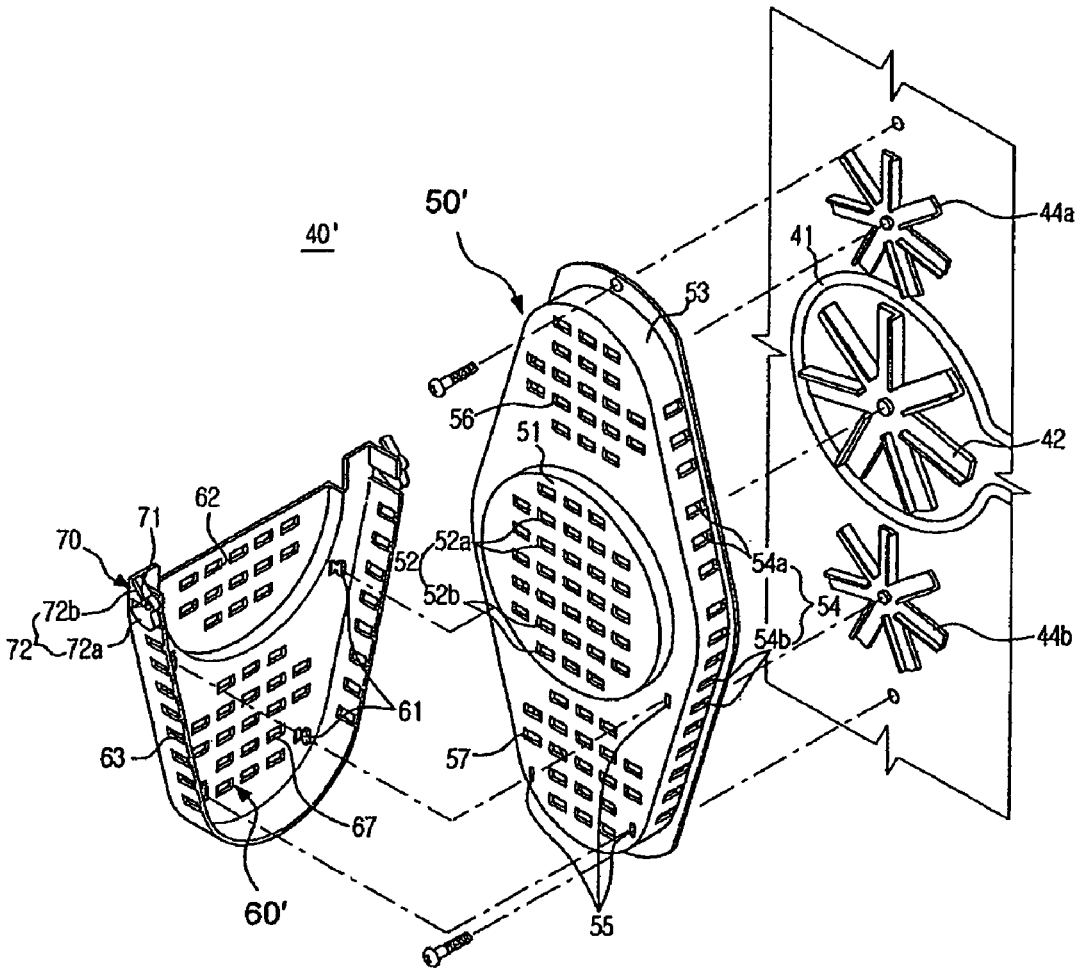
FIG. 9 is an exploded perspective view illustrating a modification of the hot air supply unit included in the cooking apparatus according to the first embodiment.

FIG. 9 is an exploded perspective view illustrating a modification of the hot air supply unit included in the cooking apparatus according to the first embodiment.

As shown in FIG. 9, a hot air supply unit 40' further includes upper and lower auxiliary fans 44*a* and 44*b* mounted above and below the blowing fan 42 in addition to the components of the hot air supply unit included in the cooking apparatus according to the first embodiment. Correspondingly, the fan cover 50' is provided with upper auxiliary inlet holes 56 for the upper auxiliary fan 44*a* and lower auxiliary inlet holes 57 for the lower auxiliary fan 44*b*. The opening and closing cover 60 is provided with lower auxiliary inlet holes 67 corresponding to the lower auxiliary inlet holes 57.

In the above-described embodiment, the opening and closing cover 60' of the hot air supply unit 40' opens and closes the lower inlet holes and the lower outlet holes of the fan cover to interrupt the supply of hot air into the second cooking chamber. However, it is also possible to construct the hot air supply unit such that the opening and closing cover is mounted to the upper part of the fan cover to open and close the upper inlet holes and the upper outlet holes of the fan cover, thereby interrupting the supply of hot air into the first cooking chamber.

Furthermore, the above-described embodiment is constructed in a structure in which the fan cover of the hot air supply unit partially protrudes from the rear of the inner case, and the fan cover is provided with the inlet holes and the outlet holes. However, the technical concept of the present embodiment may be applied to a convection-type cooking apparatus constructed in a structure in which the hot air supply unit does not protrude from the rear of the inner case. Specifically, a convection-type cooking apparatus having inlet holes formed at a center of a rear of the cavity and outlet holes formed at upper and lower lateral-side ends of the rear of the inner case may be provided with an opening and closing cover to open and close upper or lower inlet and outlet holes formed at the rear of the inner case.

Hereinafter, a cooking apparatus according to a second embodiment will be described.

Figure 10:
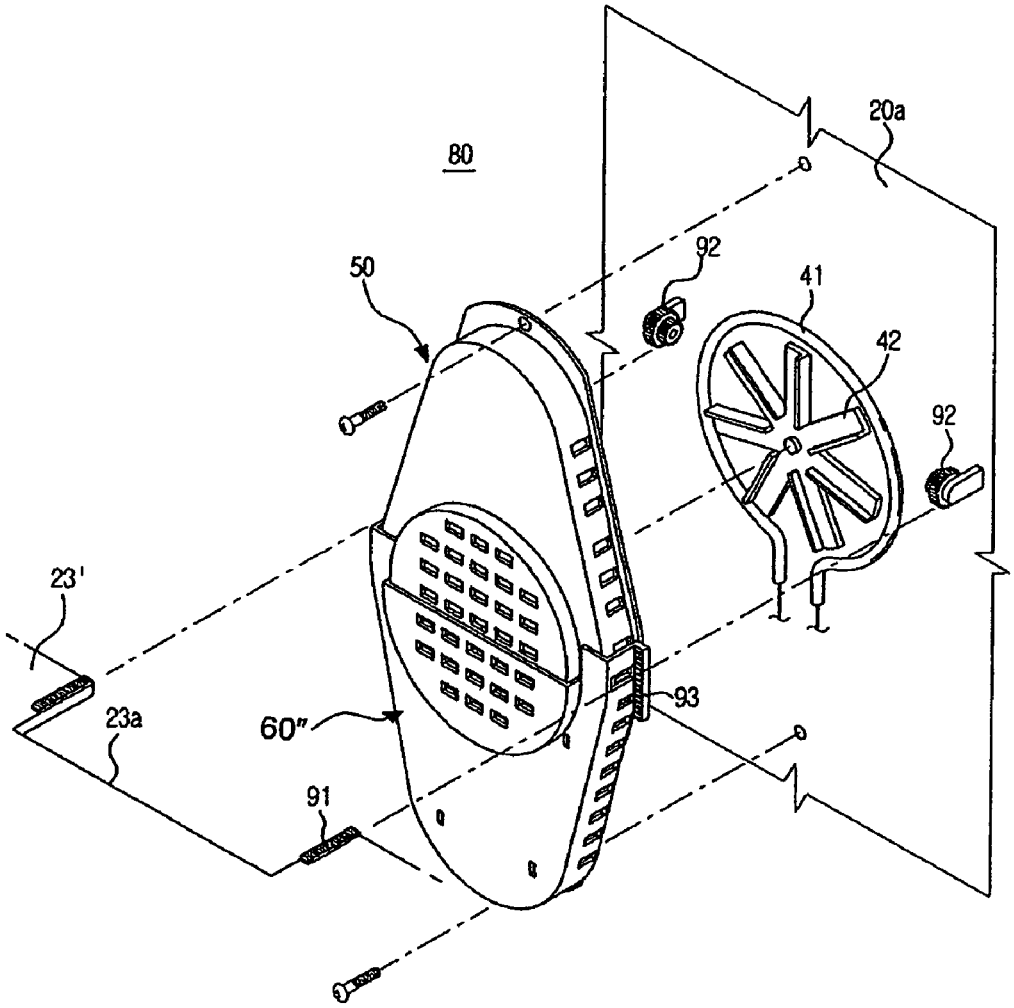
FIG. 10 is an exploded perspective view illustrating a hot air supply unit and a divider of a cooking apparatus according to a second embodiment.
Figure 11:
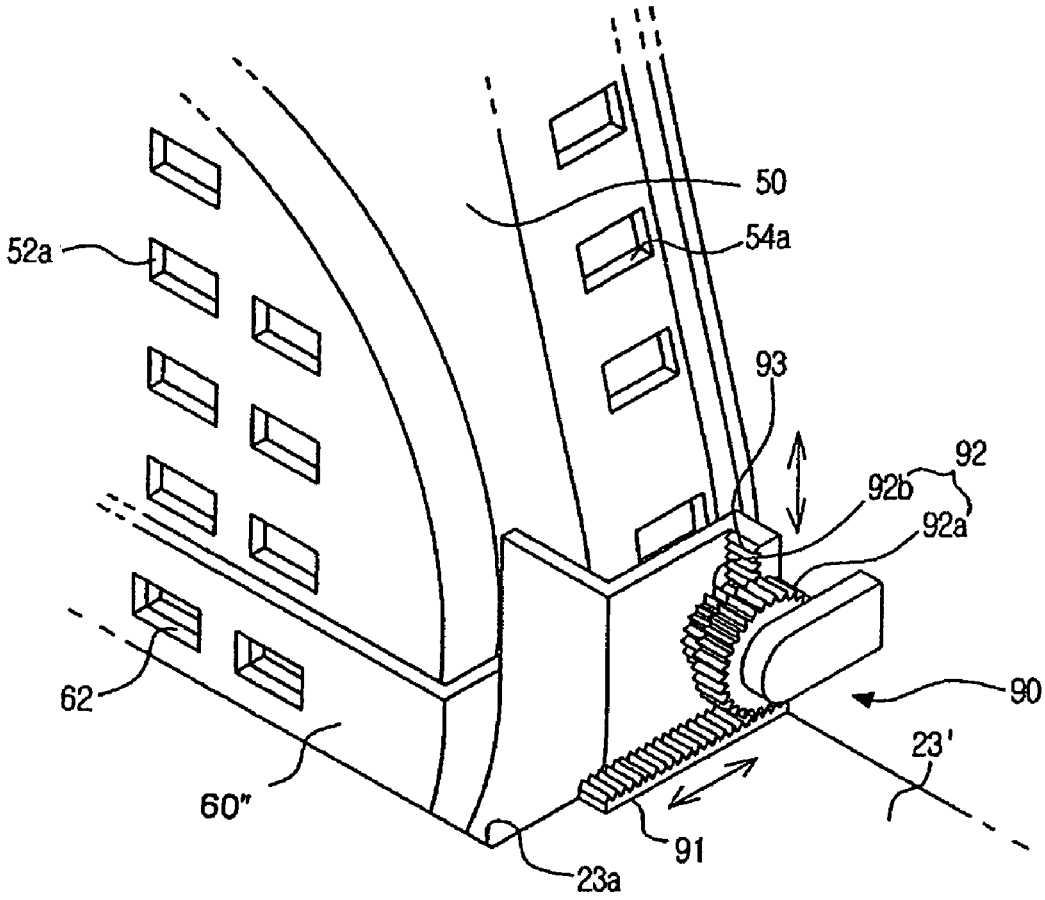
FIG. 11 is a perspective view illustrating the operational coupling between the divider and the hot air supply unit of FIG. 10.

FIG. 10 is an exploded perspective view illustrating a hot air supply unit and a divider of a cooking apparatus according to a second embodiment, and FIG. 11 is a perspective view illustrating an operational coupling between the divider and the hot air supply unit of FIG. 10. Components of the cooking apparatus according to the second embodiment, which are identical to those of the cooking apparatus according to the first embodiment, are denoted by the same reference numerals, and a description thereof will not be given.

The cooking apparatus according to the second embodiment is identical in construction to the cooking apparatus according to the first embodiment except for an interlocking unit to move the opening and closing cover of the hot air supply unit upward and downward.

As shown in FIGS. 10 and 11, the cooking apparatus according to the second embodiment includes a hot air supply unit 80, which includes a heater 41, a blowing fan 42 mounted in the heater 41 to forcibly supply air heated by the heater 41 into the cooking chamber 20, a fan cover 50 having inlet holes 52 and outlet holes 54 (shown more clearly in FIG. 2) to cover the blowing fan 42, an opening and closing cover 60" to open and close lower inlet holes 52*b* and lower outlet holes 54*b* of the fan cover 50, and an interlocking unit 90 operating together with the attachment and detachment of a divider 23' to move the opening and closing cover 60' upward and downward.

The interlocking unit 90 includes a pair of first racks 91 formed at opposite sides of the insertion groove 23*a* of the divider 23', a pair of pinions 92 protruding from corresponding positions at the rear 20*a* of the cooking chamber 20 such that the pinions 92 are rotated by the forward-and-backward movement of the first racks 91, and a pair of second racks 93 mounted at side flanges of the opening and closing cover 60" to move the opening and closing cover 60" upward and downward with the rotation of the pinions 92.

The pinions 92 protrude from the rear 20*a* of the cooking chamber 20 such that the pinions 92 are rotated by the forward-and-backward movement of the first racks 91. Each pinion 92 includes a first pinion part 92*a* coupled to the corresponding first rack 91 and a second pinion part 92*b* coupled to the corresponding second rack 93 when the divider 23' is installed in the cooking chamber 20. The first pinion part 92*a* and the second pinion part 92*b* may have the same size or different sizes. Specifically, the first pinion part 92*a* and the second pinion part 92*b* are constructed to have the same size when it is required that the forward-and-backward movement distance of the first rack 91 of the divider 23' be equal to the vertical movement distance of the opening and closing cover 60". On the other hand, the first pinion part 92*a* and the second pinion part 92*b* are constructed such that the second pinion part 92*b* has a size greater than that of the first pinion part 92*a* when it is required that the vertical movement distance of the opening and closing cover 60" be greater than the forward-and-backward movement distance of the first rack 91 of the divider 23'.

When the divider 23' is not mounted in the cooking chamber 20 of the cooking apparatus according to the second embodiment, the inlet holes 62 and outlet holes 63 of the opening and closing cover 60" communicate with the lower inlet holes 52*b* and the lower outlet holes 54*b* of the fan cover 50, respectively.

When the divider 23' is inserted into the cooking chamber 20, the pinions 92 are rotated by the first racks 91, and the second racks 93 engaged with the second pinion parts 92*b* of the respective pinions 92 move upward. As a result, the opening and closing cover 60" moves upward to fully close the lower inlet holes 52*b* and the lower outlet holes 54*b* of the fan cover 50.

Consequently, it is possible for a user to supply hot air uniformly into the cooking chamber 20 using the hot air supply unit 80 when the divider 23' is not mounted in the cooking chamber 20. Also, it is possible for the user to mount the divider 23' in the cooking chamber 20, such that the cooking chamber 20 is divided into the first and second cooking chambers 21 and 22, and therefore hot air is supplied into the first cooking chamber 21 while the supply of hot air into the second cooking chamber 22 is completely interrupted.

Hereinafter, a cooking apparatus according to a third embodiment will be described.

Figure 12:
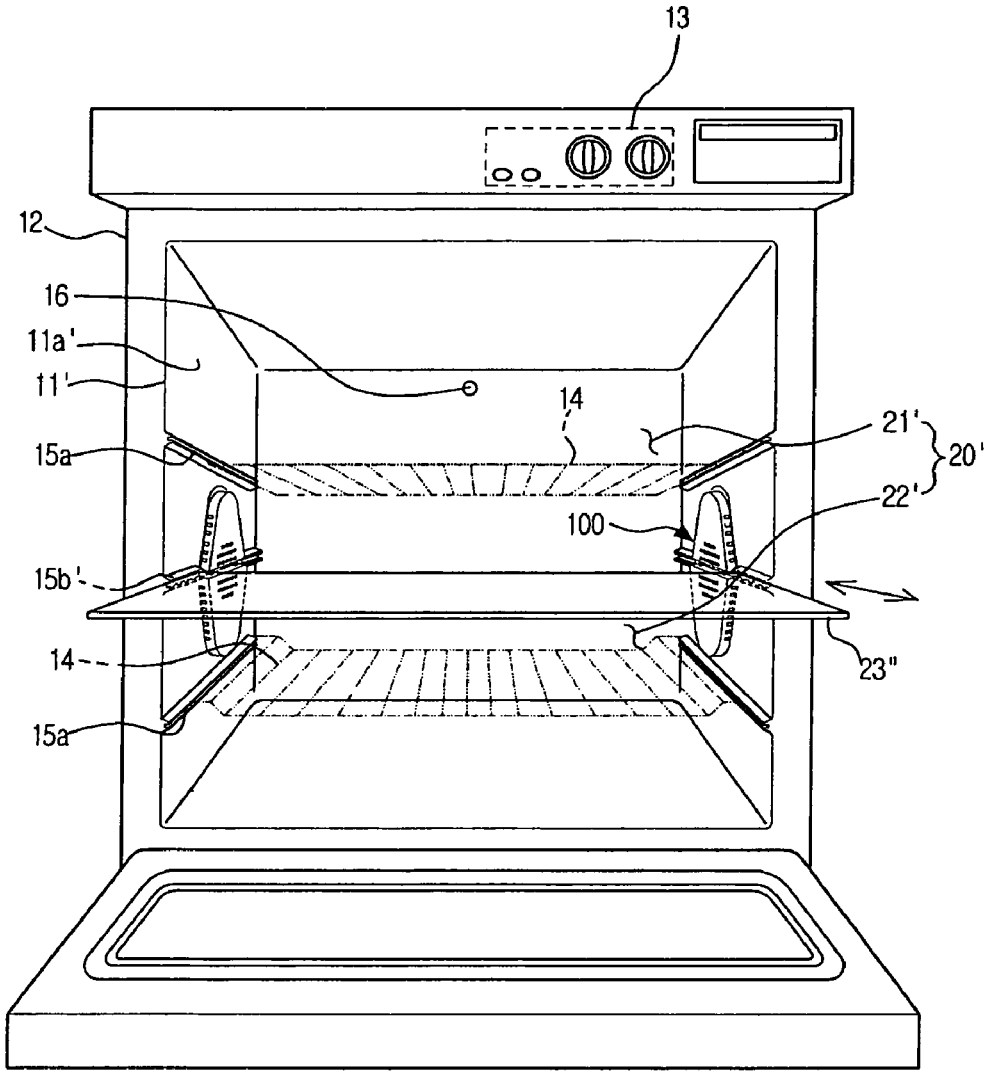
FIG. 12 is a perspective view schematically illustrating the structure of a cooking apparatus according to a third embodiment.
Figure 13:
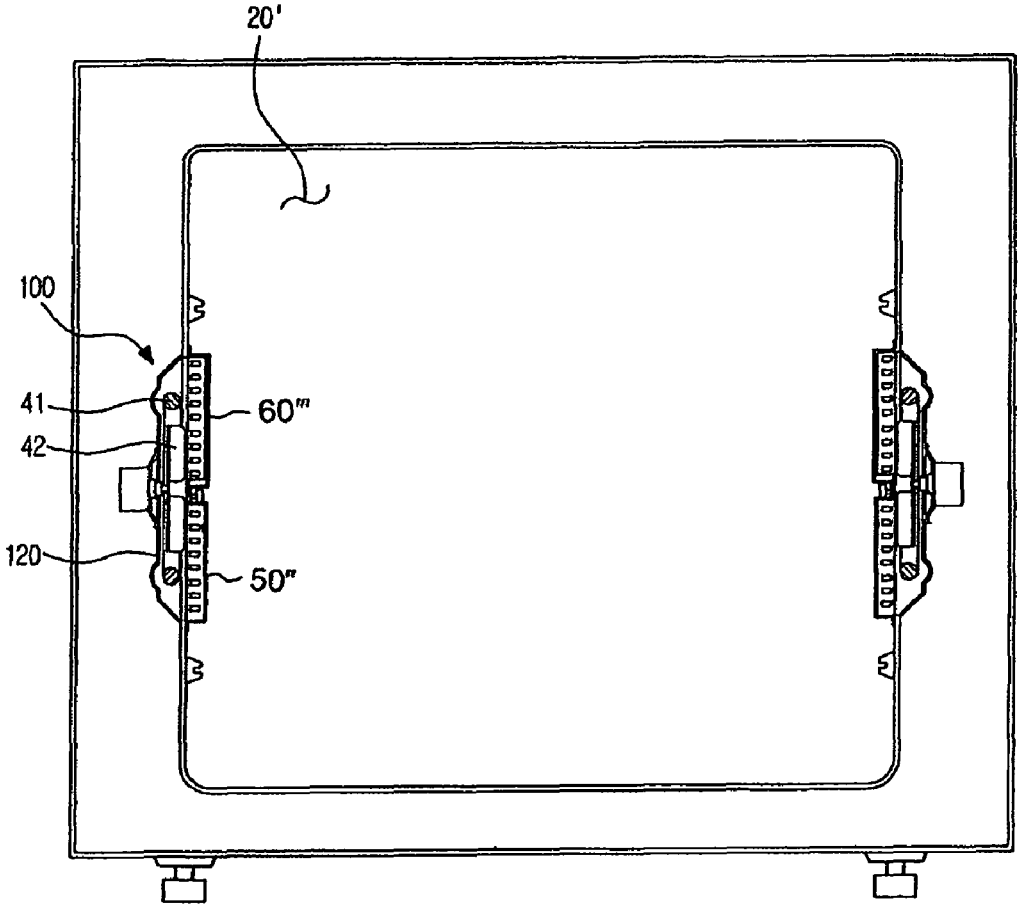
FIG. 13 is a sectional view of the cooking apparatus according to the third embodiment.
Figure 14:
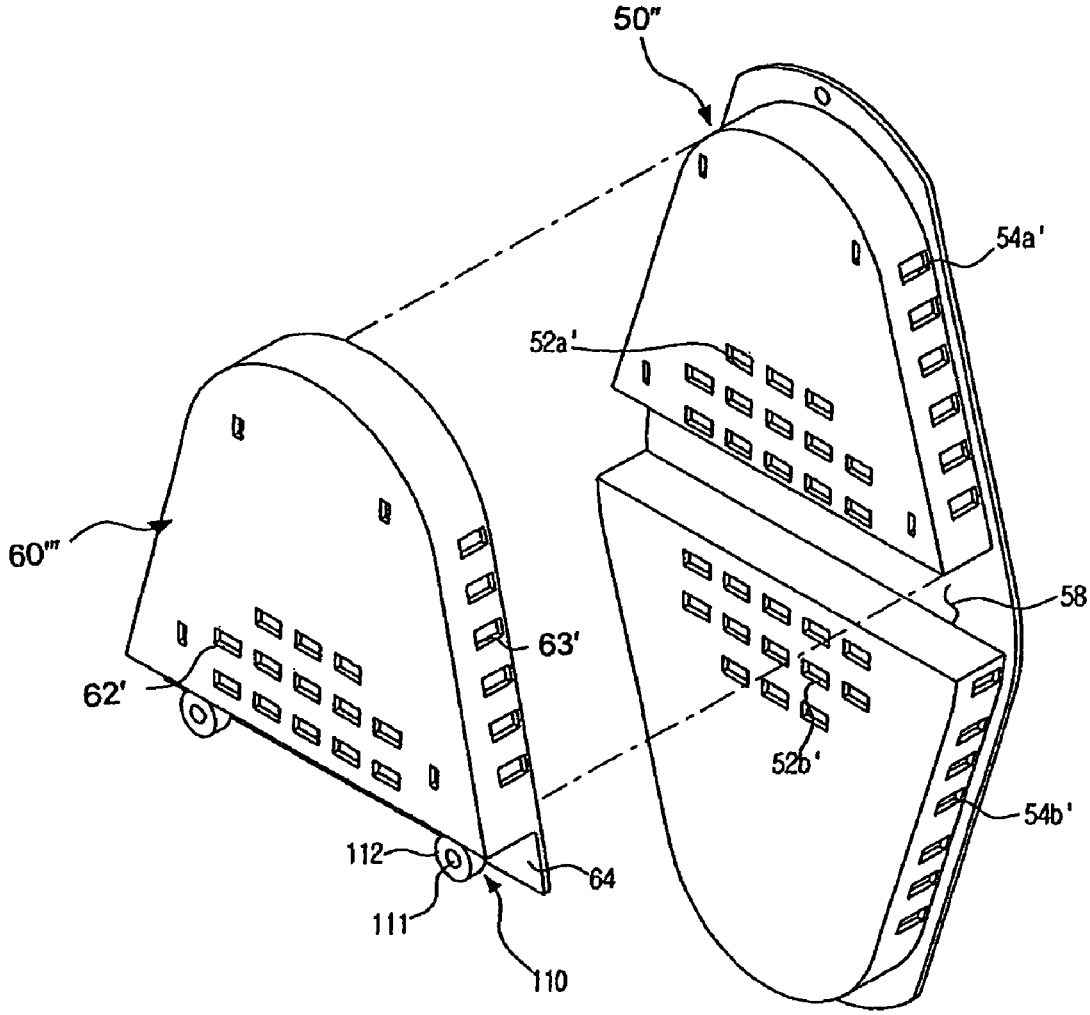
FIG. 14 is an exploded perspective view illustrating a hot air supply unit of the cooking apparatus according to the third embodiment.
Figure 15:
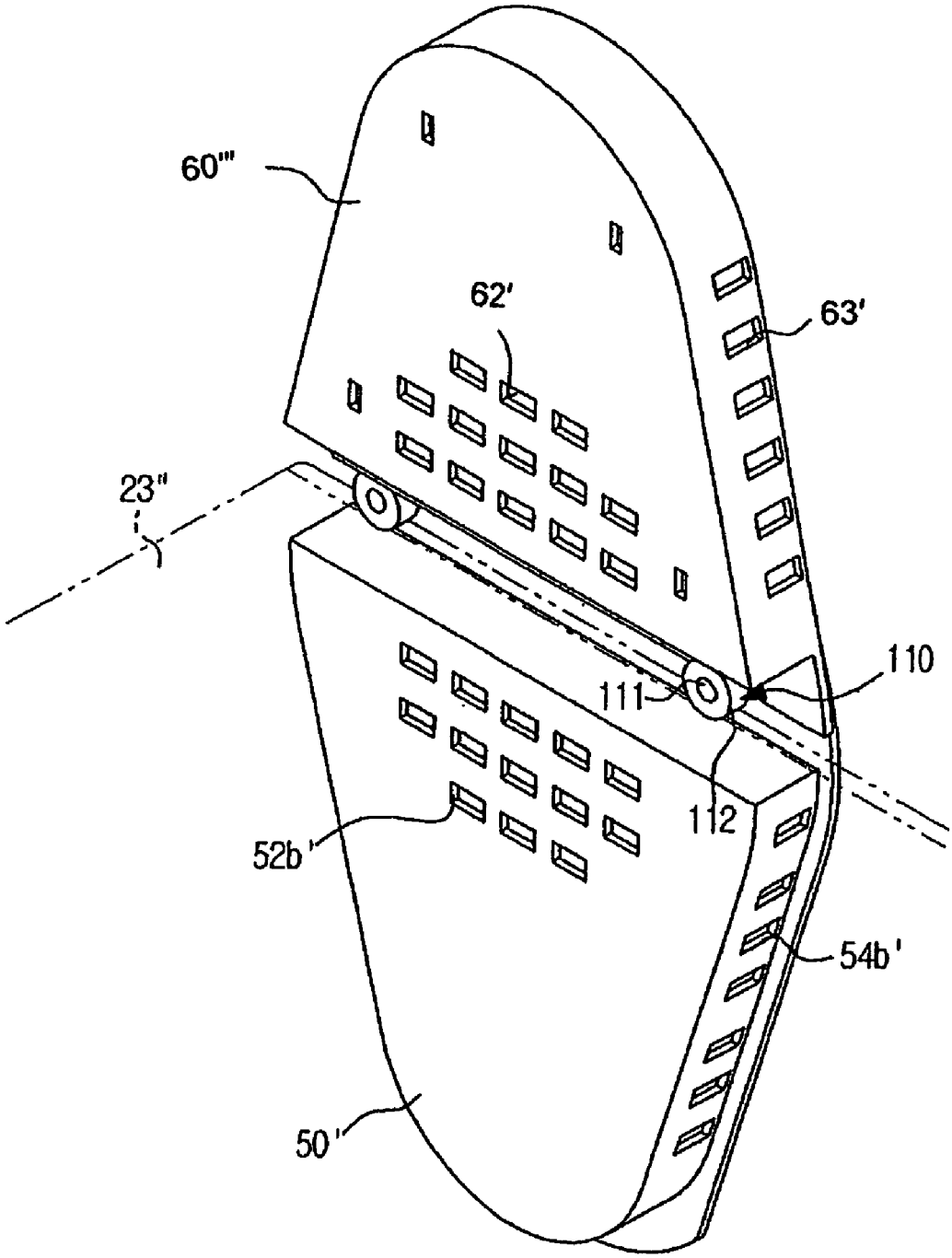
FIG. 15 is a perspective view of the hot air supply unit of FIG. 14, to which a divider is mounted.

FIG. 12 is a perspective view schematically illustrating the structure of a cooking apparatus according to a third embodiment, FIG. 13 is a sectional view of the cooking apparatus according to the third embodiment, FIG. 14 is an exploded perspective view illustrating a hot air supply unit of the cooking apparatus according to the third embodiment, and FIG. 15 is a perspective view of the hot air supply unit of FIG. 14, to which a divider is mounted. Components of the cooking apparatus according to the third embodiment, which are identical to those of the cooking apparatus according to the first embodiment, are denoted by the same reference numerals, and therefore a description thereof will not be given.

The cooking apparatus according to the third embodiment is identical in construction to the cooking apparatus according to the first embodiment except for interlocking units operating together with a divider to move opening and closing covers upward and downward, hot air supply units being mounted to opposite sides of the cooking chamber, and the divider being inserted along guide grooves formed across the middles of the hot air supply units to drive simultaneously the opening and closing covers of the respective hot air supply units.

As shown in FIGS. 12 and 13, the cooking apparatus according to the third embodiment includes a rectangular divider 23" detachably mounted in a cooking chamber 20' to divide the cooking chamber 20' into first and second cooking chambers 21' and 22', and a pair of hot air supply units 100 mounted to opposite sides of the cooking chamber 20' to operate together with the divider 23" to selectively supply hot air into the cooking chamber 20'.

The pair of hot air supply units 100 are mounted to the opposite sides of the cooking chamber 20' to reduce the cooking time through the smooth supply of hot air into the cooking chamber 20'.

At each side 11*a*' of an inner case 11' is formed a depression 120, in which a heater 41 and a blowing fan 42 of each hot air supply unit 100, which will be described below, is mounted such that the heater 41 and the blowing fan 42 do not protrude into the cooking chamber 20'.

Each hot air supply unit 100 according to the third embodiment is different in construction from the hot air supply unit 40 according to the first embodiment of the present invention. Specifically, as shown in FIGS. 14 and 15, each hot air supply unit 100 includes a fan cover 50", an opening and closing cover 60'" to open and close upper inlet holes 52*a*' and upper outlet holes 54*a*' formed at the upper part of the fan cover 50', and interlocking units 110 operating together with the attachment and detachment of the divider 23" to move the opening and closing cover 60'" upward and downward.

The fan cover 50" is formed approximately in the shape of an oval, although is not limited thereto, and has a predetermined thickness. Consequently, the fan cover 50" protrudes from opposite sides of the inner case 11'. Across the middle of the fan cover 50" is formed a guide groove 58, along which the divider 23" is slidable. The guide groove 58 has almost the same height as the corresponding side surface of the cooking chamber 20'. Consequently, when the divider 23" is mounted in the cooking chamber 20', the occurrence of a gap between the side surface of the divider 23" and the corresponding side surface of the cooking chamber 20' is prevented.

The opening and closing cover 60'" is mounted at the upper part of the fan cover 50" such that the opening and closing cover 60'" can move upward and downward. The opening and closing cover 60'" is provided with inlet holes 62' and outlet holes 63' corresponding to the upper inlet holes 52*a*' and the upper outlet holes 54*a*' of the fan cover 50", respectively. The opening and closing cover 60'" is provided at a lower end thereof with a bent portion 64, which extends to a front of the guide groove 58 when the opening and closing cover 60'" is attached to the fan cover 50".

Each interlocking unit 110 is mounted to the corresponding bent portion 64 to operate together with the attachment and detachment of the divider 23" to move the opening and closing cover 60'" upward and downward. Each interlocking unit 110 includes a rotary shaft 111 protruding from the bent portion 64 and a roller 112 coupled to the rotary shaft 111 such that the roller 112 can rotate relative to the rotary shaft 111.

When the divider 23" is inserted into the cooking chamber 20' along the guide groove 58, the divider 23" raises the roller 112. For this reason, as shown in FIG. 15, the end of the divider 23" is preferably inclined or rounded to accomplish the smooth insertion of the divider 23" and the smooth rise of the roller 112.

When the divider 23" is not mounted in the cooking chamber 20', therefore, the inlet holes 62' and outlet holes 63' of the opening and closing cover 60'" communicate with the upper inlet holes 52*a*' and the upper outlet holes 54*a*' of the fan cover 50', respectively. As a result, air flows through the upper and lower inlet holes 52*a*' and 52*b*' and the upper and lower outlet holes 54*a*' and 54*b*' of the fan cover 50' when the blowing fan 42 is driven.

On the other hand, when the divider 23" is mounted in the cooking chamber 20', the divider 23" is guided along middle guides 15*b*' formed at each side 11*a*' of the cooking chamber 20', and is then inserted between the lower end of the guide groove 58 and the roller 111. As a result, as shown in FIG. 15, the roller 112 moves upward, and therefore, the opening and closing cover 60'" to which the roller 112 is mounted moves upward. Consequently, the inlet holes 62' and the outlet holes 63' of the opening and closing cover 60'" are not aligned with the upper inlet holes 52*a*' and the upper outlet holes 54*a*' of the fan cover 50', and therefore, the opening and closing cover 60'" closes the upper inlet holes 52*a*' and the upper outlet holes 54*a*' of the fan cover 50", and the supply of hot air into the first cooking chamber 21' is interrupted.

In the cooking apparatus constructed in a structure in which the hot air supply units 100 are mounted at opposite sides of the cooking chamber 20' as described above, it is possible to interrupt the supply of hot air into any one of the first and second cooking chambers 20' using the divider 23", such that a small amount of food is cooked in a small-sized cooking space, thereby reducing the cooking time and the power consumption.

In this embodiment, the opening and closing cover to cover the inlet holes and the outlet holes are mounted at the upper part of the fan cover. However, the opening and closing cover may be mounted at the lower part of the fan cover as in the previous embodiments. In this embodiment, the hot air supply units are mounted at the sides of the inner case. However, the hot air supply unit may be mounted at the rear of the inner case. Furthermore, when the hot air supply unit is mounted at the rear of the inner case, the interlocking unit including the roller may be modified such that the interlocking unit is mounted to the edge of the opening and closing cover as in the first embodiment:

In this embodiment, the guide groove is formed across the middle of the fan cover to receive the divider, and the interlocking unit is mounted to the bent portion of the opening and closing cover. However, this structure of the opening and closing cover may be modified such that the opening and closing cover is applied to the first and second embodiments wherein the hot air supply unit is mounted at the rear of the inner case.

Also, it is possible to apply the interlocking unit according to the first and second embodiments to the opening and closing cover constructed in a structure in which the hot air supply units are mounted at the sides of the inner case, the guide groove is formed across the middle of the fan cover to receive the divider, and the interlocking unit is mounted at the bent portion.

As apparent from the above description, the cooking apparatus according to the present embodiments has the effect of opening and closing the inlet holes and the outlet holes of the fan cover through a relatively simple mechanical structure, i.e., the opening and closing cover movable upward by the interlocking unit operating together with the divider, without using an additional control unit, thereby partially heating a cooking chamber depending upon the amount of food to be cooked.

Furthermore, the cooking apparatus according to the present embodiments has the effect of opening and closing the inlet holes and the outlet holes formed at the fan cover when the cooking chamber is partially heated, such that the supply of hot air to a predetermined space is allowed or interrupted, thereby preventing the frequent on/off operation of the blowing fan or the heater and thus increasing the life span of components of the cooking apparatus.

Although a few embodiments have been shown and described, it would be appreciated by those skilled in the art that changes may be made in this embodiment without departing from the principles and spirit of the invention, the scope of which is defined in the claims and their equivalents.

What is claimed is:

1. A cooking apparatus, comprising:

a cooking chamber;

a hot air supply unit to supply hot air into the cooking chamber, the hot air supply unit including a heater, a blowing fan to supply air heated by the heater into the cooking chamber, a fan cover having inlet holes and outlet holes, an opening and closing cover to partially open and close the inlet holes and the outlet holes of the fan cover, and interlocking units; and a divider to divide the cooking chamber, wherein the interlocking units operate together with the divider to in attachment and detachment of the divider to move the opening and closing cover.

2. The cooking apparatus according to claim 1, wherein the opening and closing cover is provided at a rear thereof with hooks, the fan cover is provided at a front thereof with hook grooves, and the hook grooves receive the hooks when the opening and closing cover is attached to the fan cover.

3. The cooking apparatus according to claim 1, wherein each interlocking unit includes a rotary shaft fixed to the opening and closing cover and an interlocking part coupled to the rotary shaft such that the interlocking part is rotated upon the attachment and detachment of the divider.

4. The cooking apparatus according to claim 3, wherein the interlocking part includes a first rotation part brought into contact with the divider and rotated upon the attachment of the divider and a second rotation part spaced a predetermined angle from the first rotation part, the second rotation part operating together with the rotation of the first rotation part to press a top surface of the divider.

5. The cooking apparatus according to claim 4, wherein the first rotation part has a weight greater than that of the second rotation part such that the first rotation part is located below the second rotation part due to the weight of the first rotation part before the attachment of the divider.

6. The cooking apparatus according to claim 4, wherein the first and second rotation parts have rounded side ends.

7. The cooking apparatus according to claim 3, wherein the fan cover and the opening and closing cover protrude from a rear of the cooking chamber, the divider has an insertion groove to surround the fan cover and the opening and closing cover, and each interlocking unit is mounted to an edge of the opening and closing cover.

8. The cooking apparatus according to claim 3, wherein the fan cover protrudes from a rear or a side of the cooking chamber, the fan cover has a guide groove to receive the divider, the opening and closing cover has a bent portion corresponding to the guide groove of the fan cover, and each interlocking unit is mounted to the bent portion of the opening and closing cover.

9. The cooking apparatus according to claim 1, wherein each interlocking unit includes a first rack formed at the divider, a pinion protruding from an inside of the cooking chamber such that the pinion is rotated by a forward-and-backward movement of the first rack, and a second rack mounted to the opening and closing cover to move with the rotation of the pinion.

10. The cooking apparatus according to claim 9, wherein the pinion includes a first pinion part coupled to the first rack and a second pinion part coupled to the second rack.

11. The cooking apparatus according to claim 9, wherein the fan cover and the opening and closing cover protrude from the rear of the cooking chamber, the divider has an insertion groove to surround the fan cover and the opening and closing cover, and each interlocking unit is mounted to an edge of the opening and closing cover.

12. The cooking apparatus according to claim 9, wherein the fan cover protrudes from a rear or a side of the cooking chamber, the fan cover has a guide groove to receive the divider, the opening and closing cover has a bent portion corresponding to the guide groove of the fan cover, and each interlocking unit is mounted to the bent portion of the opening and closing cover.

13. The cooking apparatus according to claim 1, wherein each interlocking unit includes a rotary shaft fixed to the opening and closing cover and a roller rotatably coupled to the rotary shaft.

14. The cooking apparatus according to claim 13, wherein the divider has inclined or rounded ends.

15. The cooking apparatus according to claim 13, wherein the fan cover and the opening and closing cover protrude from a rear of the cooking chamber, the divider has an insertion groove to surround the fan cover and the opening and closing cover, and each interlocking unit is mounted to an edge of the opening and closing cover.

16. The cooking apparatus according to claim 13, wherein the fan cover protrudes from a rear or a side of the cooking chamber, the fan cover has a guide groove to receive the divider, the opening and closing cover has a bent portion corresponding to the guide groove of the fan cover, and each interlocking unit is mounted to the bent portion of the opening and closing cover.

* * * * *